US005544644A

United States Patent [19]

Adler

[11] Patent Number: 5,544,644

[45] Date of Patent: Aug. 13, 1996

[54] DRYING AND IRONING MACHINE HAVING A ROTARY CYLINDER EQUIPPED WITH AN IMPROVED PIPE BURNER

[75] Inventor: Michel Adler, Villery, France

[73] Assignee: Dubix De Souza SNC, Pres Troyes, France

[21] Appl. No.: 426,859

[22] Filed: Apr. 24, 1995

[30] Foreign Application Priority Data

May 13, 1994 [FR] France ..... 94 05904

[51] Int. Cl.[6] ..... F24C 3/00

[52] U.S. Cl. ..... 126/91 R; 126/92 AC; 431/328

[58] Field of Search ..... 126/92 AC, 91 R; 431/328; 34/110

[56] References Cited

U.S. PATENT DOCUMENTS

| | | | |
|---|---|---|---|
| 2,141,377 | 12/1938 | Chylinski | 34/110 |
| 3,119,439 | 1/1964 | Weiss | 126/91 R |
| 3,445,175 | 5/1969 | Krieger | 431/328 |
| 3,488,137 | 1/1970 | Naganuma . | |
| 3,515,380 | 6/1970 | Lazaridis | 126/91 R |
| 3,857,670 | 12/1974 | Karlovetz et al. . | |
| 4,809,674 | 3/1989 | Kamberg . | |
| 5,054,543 | 10/1991 | Thomas et al. . | |

FOREIGN PATENT DOCUMENTS

| | | |
|---|---|---|
| 1-098807 | 4/1989 | Japan . |
| 1291007 | 11/1989 | Japan . |

*Primary Examiner*—John T. Kwon

*Attorney, Agent, or Firm*—Pearne, Gordon, McCoy & Granger

[57] ABSTRACT

Use is made in a drying and ironing machine having a rotary cylinder (10) of a pipe burner (18), which comprises a dense network of microperforations. Microflames mainly form in the microperforations and ensure a heating mainly in the infrared range. It is thus possible to orient the microflames towards that part of the cylinder (10) which is in contact with the linen or laundry. By placing the pipe burner (18) in the bottom of the cylinder and a combustion product recovery pipe in the top, there is a sweep (F2) of a part of the cylinder by the combustion products. Therefore the performance characteristics of the machine are improved and its manufacturing costs are reduced.

10 Claims, 5 Drawing Sheets

Figure 1:
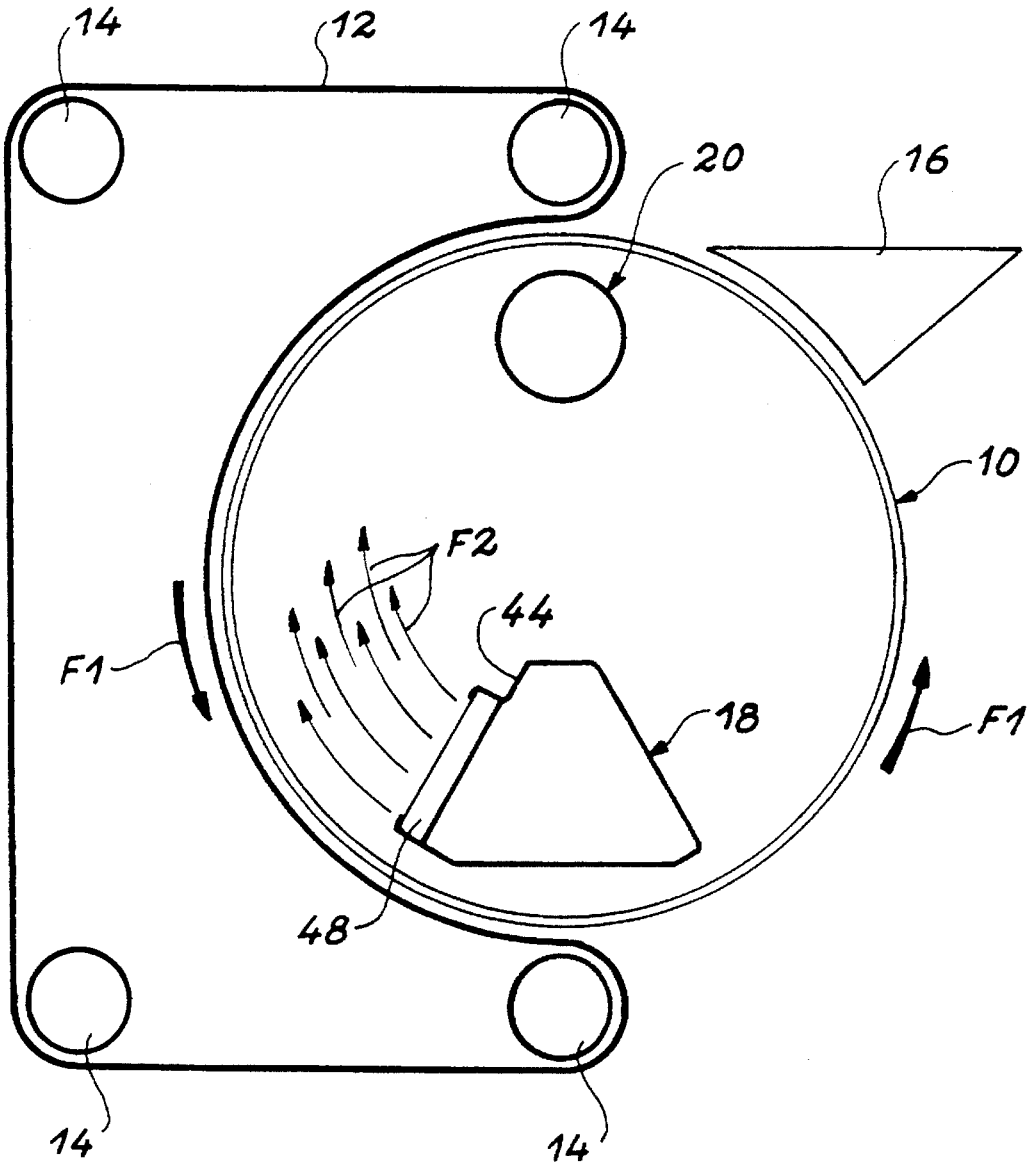

DRYING AND IRONING MACHINE HAVING A ROTARY CYLINDER EQUIPPED WITH AN IMPROVED PIPE BURNER

DESCRIPTION

The invention relates to a drying and ironing machine having a rotary cylinder, in which the latter is heated by means of a pipe burner located in the interior thereof.

The drying and ironing machine according to the invention can be used in all conventional fields of use of such a machine, i.e. particularly in installations involving the ironing of large quantities of linen (hospitals, boarding schools, hotels, restaurants, etc.).

As is more particularly illustrated by FR-A-2,479,789 a drying and ironing machine with a rotary cylinder is a machine in which the linen to be ironed is introduced at the top, in the front of the machine, between the rotating cylinder and a belt or a group of endless belt members. A gas, steam or electrical heating source is placed within the cylinder in order to contribute to the drying and ironing of the linen or laundry. Once dried and ironed, it passes out through the bottom, towards the front of the machine and is then collected in loose form in a front reception tub or folded by an appropriate device.

In the particular case where heating is ensured by a pipe burner, the latter is conventionally constituted by a circular tube into which the air-gas mixture is injected at one end. This mixture passes out of the pipe by means of a row of calibrated holes formed along a generatrix of the tube and is then ignited by an ignition system located outside the tube.

The pipe burners conventionally used form in general blue flames outside the pipe.

Drying and ironing machines with a rotary cylinder using pipe burners suffer from a certain number of disadvantages, which more particularly result from the formation of flames outside the pipe.

Firstly, the flames produced by existing pipe burners tend to separate, which requires the addition to the latter of an auxiliary pipe provided with a second row of calibrated perforations issuing at right angles in front of the first row of perforations.

In addition, the flames formed outside the pipe cannot be inclined with respect to the vertical. Thus, an effective sweep of the internal surface of the rotary cylinder cannot be ensured. The thermal efficiency of drying and ironing machines, whose cylinder is heated by such pipes is consequently mediocre.

Moreover, the distribution of the gas within a pipe burner having a conventional design takes place in irregular manner, which contributes to the creation of a temperature gradient along the cylinder. This can lead to an overheating of the linen in certain areas of the drying and ironing machine. In order to avoid this problem, it is often necessary to place within the same rotary cylinder two parallel pipe burners, whilst sealing the holes of one of them in the overheating areas.

The different arrangements conventionally proposed in order to obviate the disadvantages of existing pipe burners lead to this method being made relatively expensive.

Moreover, the design of the pipe burners conventionally used in drying and ironing machines having a rotary cylinder do not enable the latter to be used with all existing gas types.

The invention specifically relates to a drying and ironing machine having a rotary cylinder equipped with an improved pipe heater, whose original design eliminates the disadvantages of existing pipe heaters by bringing about the disappearance of flames outside the pipe burner, which makes it possible to incline the same and prevent their separation without it being necessary to add a second pipe burner or supplementary accessories.

According to the invention, this result is obtained by means of a drying and ironing machine having a rotary cylinder and a pipe burner comprising, within the cylinder, a pipe burner, means for supplying the latter with an air-gas mixture, connected to one end thereof, calibrated holes formed in the pipe burner in order to permit the passage of the air-gas mixture, and means for igniting the gas passing out of the calibrated holes, characterized in that the calibrated holes are constituted by a dense network of microperforations ensuring a combustion of the gas mainly within the microperforations and a heating mainly in the infrared.

The combustion of the gas takes place within the microperforations, so that there is no flame separation problem and it becomes possible to incline the perforations in order to increase the thermal efficiency of the machine.

Moreover, the infrared production within the rotary cylinder ensures a more effective and efficient heating of the latter by convection, no matter what type of gas is used and without it being necessary to use a pressurized gas.

The location of the flames within the microperforations and the infrared production are ensured both by the considerable increase in the number of calibrated holes per surface unit and by the significant decrease of their cross-section compared with the pipe burners used at present in drying and ironing machines. Thus, and solely in exemplified manner, the density of the microperforations according to the invention can be approximately 400 per $cm^2$, for a cross-section of 1180 $cm^2$ and a length of 1600 mm.

Therefore the use of a pipe burner according to the invention makes it possible to increase the performance characteristics of the machine and reduce its manufacturing costs.

The pipe burner is advantageously placed in a lower region of the rotary cylinder and the axes of the microperforations are inclined with respect to the vertical, so as to be oriented externally towards a part of the cylinder close to a linen exit zone and in the opposite direction to the cylinder rotation direction.

In this case, a combustion product recovery pipe is advantageously positioned in an upper region of the rotary cylinder, in the vicinity of the linen introduction zone, so as to ensure that the combustion products sweep a useful part of the cylinder located between the linen introduction and discharge zones.

In order to improve the regularity of heating along the pipe, the latter is advantageously equipped with at least one perforated distribution plate internally subdividing the pipe in its lengthwise direction into at least two zones.

In a first embodiment of the invention, all the supply means then issue into a first of said zones, adjacent to the end of the pipe and to which are connected the supply means. The distribtuion plate or plates ensure a substantially uniform distribution of the air-gas mixture along the pipe.

In a second embodiment of the invention, the supply means issue into each of the zones and have distribution means ensuring a controlled supply of each zone with the air-gas mixture. As a function of the width of the ironed linen, this feature makes it possible to regulate the distribution of the heating along the pipe and consequently the rotary cylinder.

In this second embodiment of the invention, the precision of the regulation can be further improved by providing means making it possible to displace each distribution plate along the axis of the pipe.

In practice, the microperforations can be formed in ceramic material plates. In this case, the pipe advantageously has a tubular metal part having a substantially planar face, parallel to its axis and in which are formed juxtaposed windows, the ceramic material plates being installed in these windows using tight fixing means.

These tight fixing means can in particular be in the form of tongues formed in the tubular metal part and lowered onto the ceramic material plates, as well as flexible sealing pads, interposed between the said plates and the frames of the windows.

The invention is described in greater detail hereinafter relative to two non-limitative, but preferred embodiments of the invention with reference to the attached drawings, wherein show:

FIG. 1 a cross-sectional view very diagrammatically illustrating the operating principle of a drying and ironing machine having a rotary cylinder and with gas heating in accordance with the invention.

Figure 2:
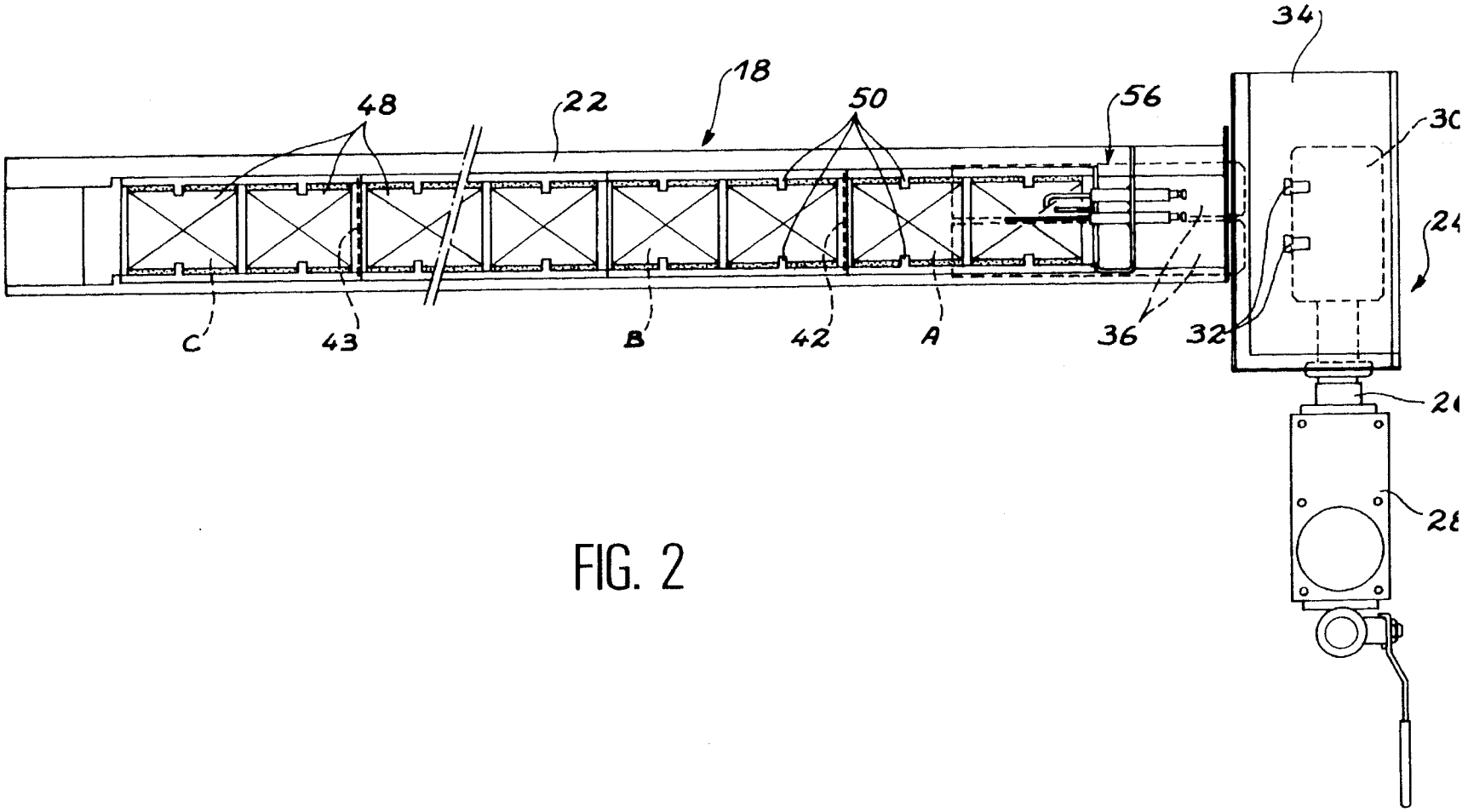

FIG. 2 a side view showing in greater detail the pipe burner equipping the drying and ironing machine of FIG. 1, according to a first embodiment of the invention.

Figure 3:
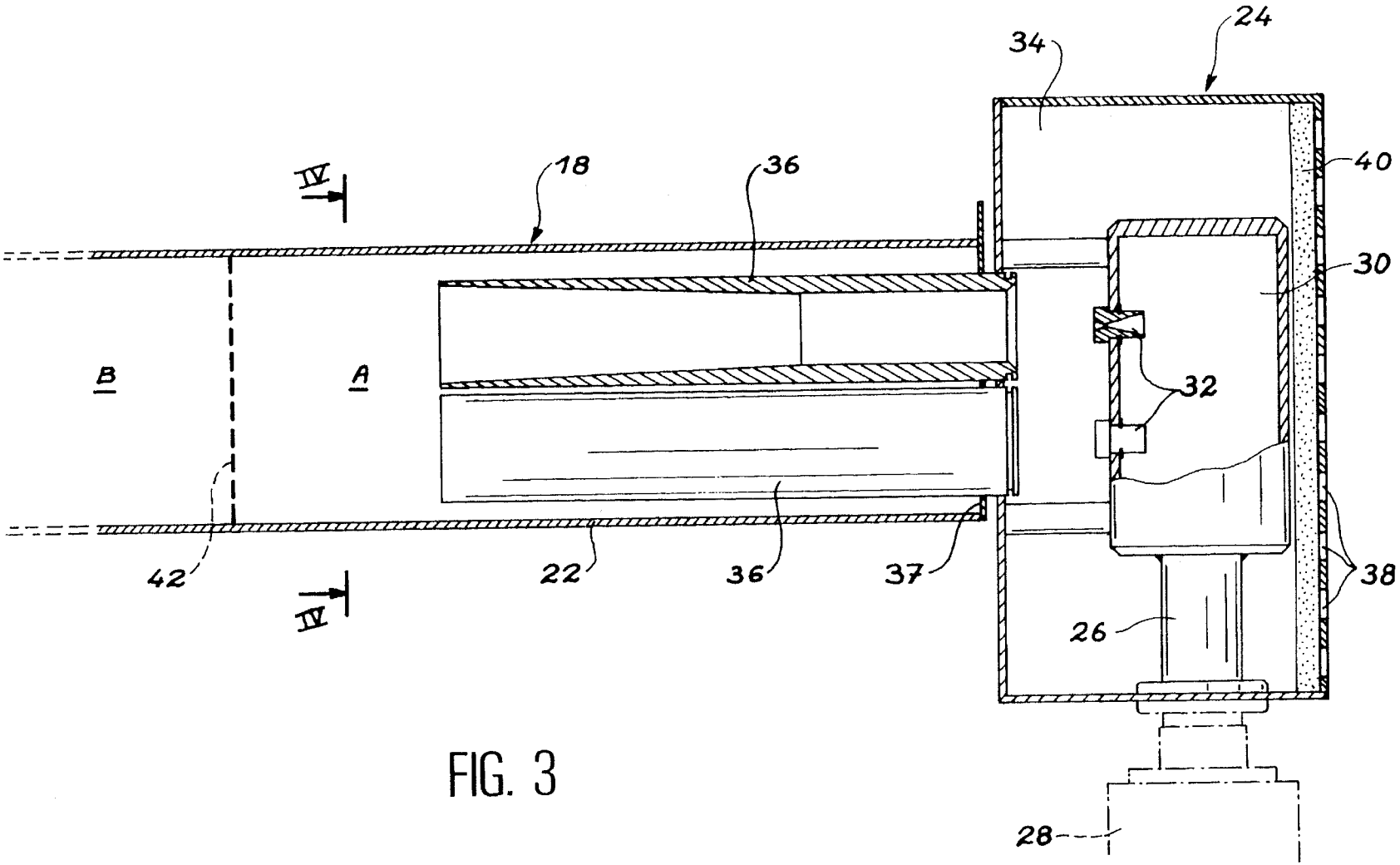

FIG. 3 a larger scale view showing in partial longitudinal section the end of the pipe of FIG. 2 by which the air-gas mixture is supplied.

Figure 4:
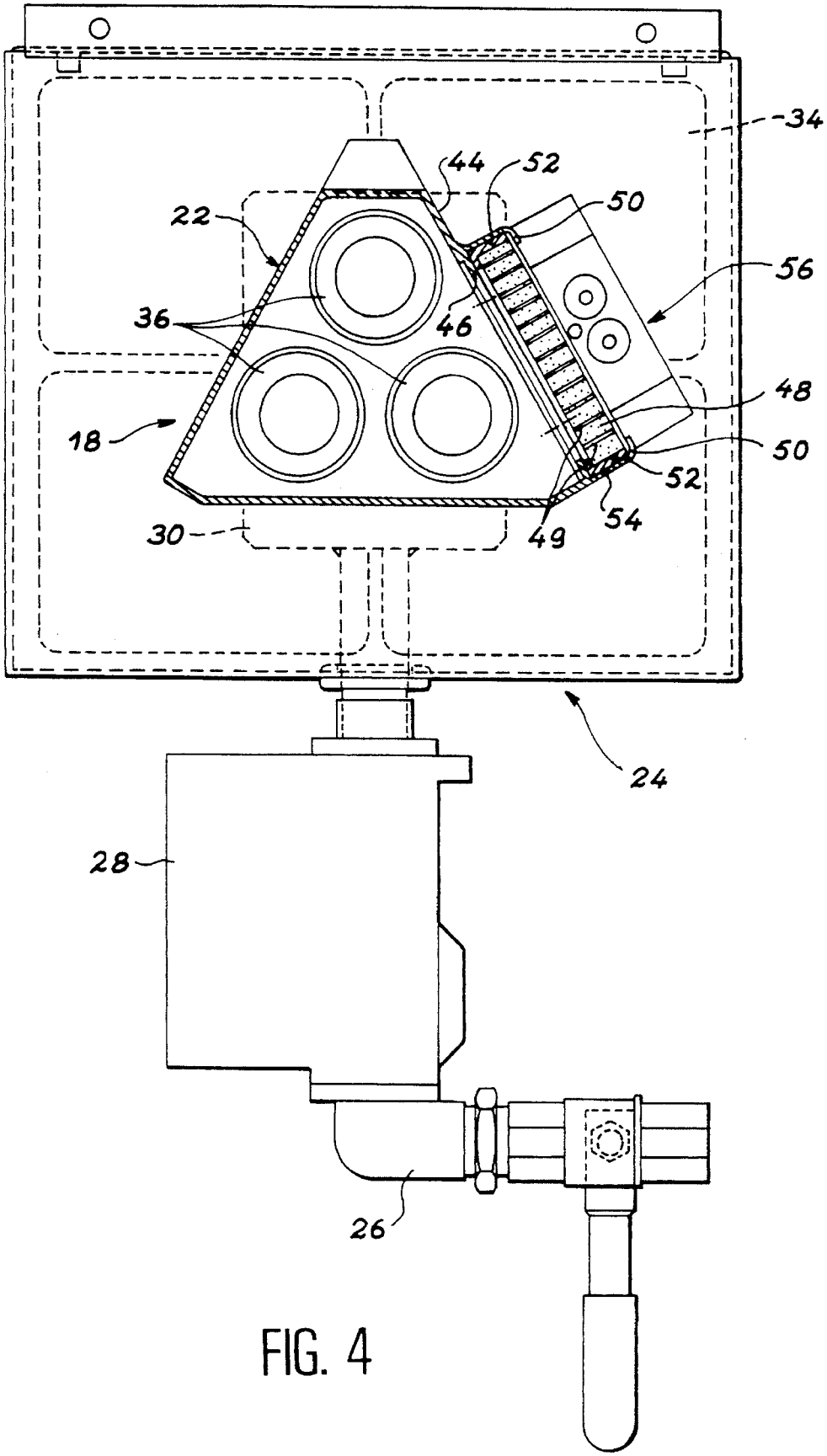

FIG. 4 a sectional view along line IV—IV of FIG. 3.

Figure 5:
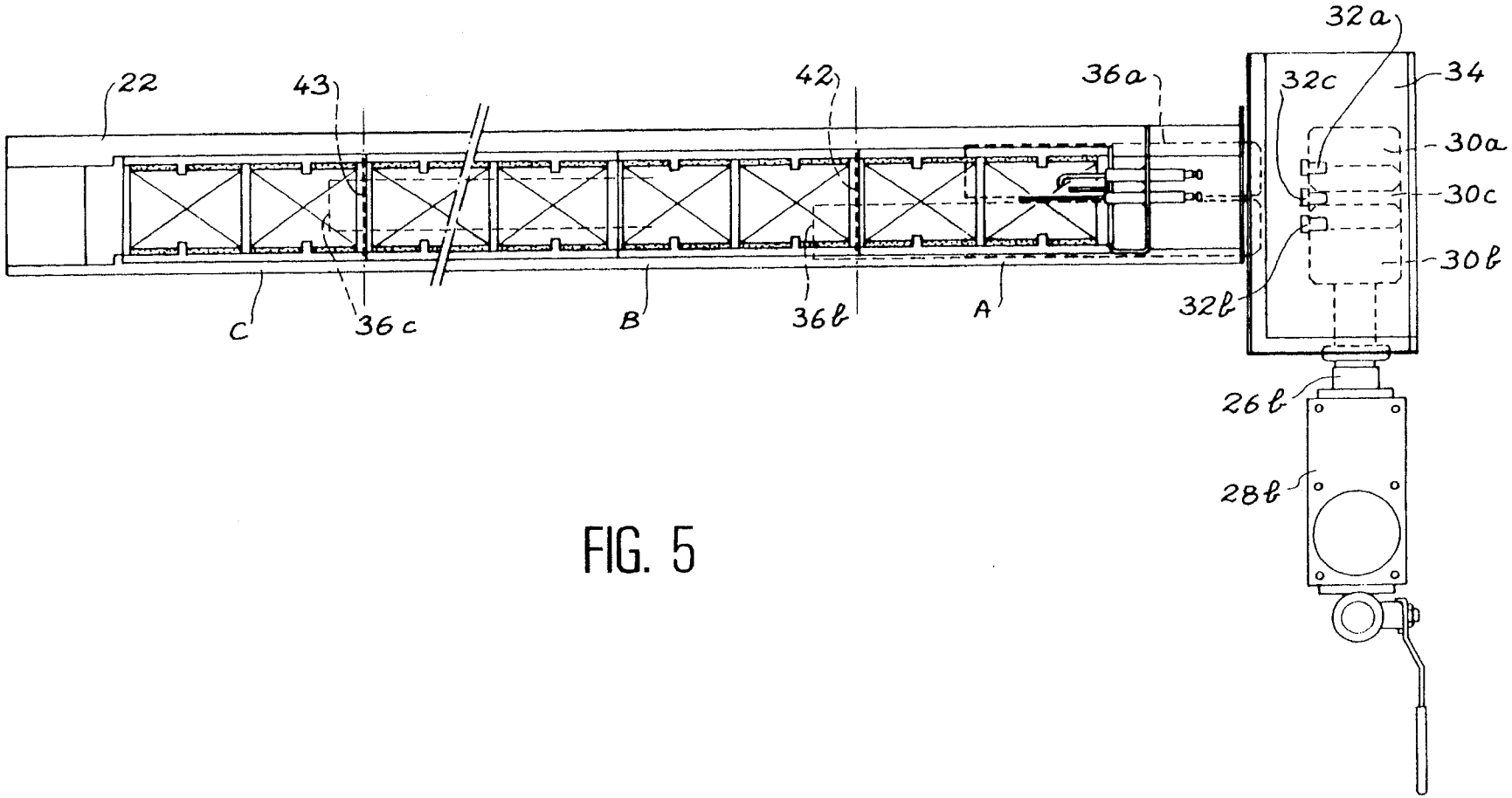

FIG. 5 a comparable view to FIG. 2 illustrating a second embodiment of the invention.

As is very diagrammatically illustrated in FIG. 1, the invention relates to a drying and ironing machine having a horizontally axed, rotary cylinder 10 and which can be rotated about said axis in the direction of the arrows F1 by conventional, not shown drive means, which do not form part of the present invention.

The drying and ironing machine very diagrammatically illustrated in FIG. 1 also comprises a belt or endless belt members 12 travelling on rollers 14, whose axes are parallel to the horizontal axis of the cylinder 10. These rollers 14 are arranged in such a way that the belt or endless belt members 12 are in contact with the rotary cylinder 10 substantially over half its circumference. More specifically, the belt or endless belt members 12 are in contact with that part of the circumference of the cylinder 10 which travels in the downwards direction when the cylinder rotates in the direction of the arrows F1 in FIG. 1.

In a drying and ironing machine of this type, the linen or laundry to be ironed is introduced into an introduction zone for the same located in the upper region of the rotary cylinder 10. To facilitate its entry into the rotary cylinder 10 and the belt or endless belt members 12, the linen is placed on an introduction system such as a horizontal tray or shelf 16 located in the vicinity of the cylinder 10 in the linen introduction zone. The linen introduced between the cylinder 10 and the belt or endless belt members 12 is driven by the latter so as to be dried and ironed, particularly under the effect of the heating of the rotary cylinder 10. The dried and ironed linen passes out of the machine in a linen discharge zone positioned in the lower region of the rotary cylinder 10. It can in particular be collected in said zone by a not shown tub provided for this purpose below the cylinder 10.

The rotary cylinder 10 is a hollow cylinder in which is received a pipe burner 18 according to the invention. This pipe burner 18 is fixed and extends parallel to the horizontal axis of the rotary cylinder 10 and over most of the length thereof. It is placed in a lower region of the cylinder, i.e. in the vicinity of the linen discharge zone.

A combustion product recovery pipe 20 is also placed within the rotary cylinder 10. This pipe 20 is fixed and extends parallel to the horizontal axis of the rotary cylinder 10 over most of the length of the latter. It is placed in an upper region of the rotary cylinder 10 above the pipe burner 18, i.e. in the vicinity of the linen introduction zone. With reference to FIGS. 2 to 4, a detailed description will now be given of a first embodiment of the pipe burner 18. The latter comprises a tubular metal part 22 having a uniform cross-section over its entire length. This cross-section, which is triangular in the embodiment shown, can assume numerous other shapes without passing outside the scope of the invention.

The left-hand end of the tubular metal part 22 in FIG. 1 is closed, whereas the opposite end communicates with the means 24 for supplying the air-gas mixture to the pipe burner 18.

Said supply means 24 comprise a gas delivery duct 26, which can be connected to a not shown gas source by any appropriate means. The gas delivery duct is equipped with a valve 28, e.g. of the all or nothing type. The valve 28 can be replaced by a tap making it possible to modify the gas flow introduced into the pipe burner 18 or into certain areas thereof, as will be described hereinafter.

The means 24 for supplying the pipe burner 18 with the air-gas mixture also comprise a compression chamber 30 into which issues the duct 26. This compression chamber 30 is equipped with one or more injectors 32 on a planar face turned towards the adjacent end of the tubular metal part 22 of the pipe 18. The dimensions of these injectors 32, which are dependent on the gas used, are sufficiently small for there always to be a pressure in the gas compression chamber 30 when the valve 28 is open. In the embodiment illustrated by FIGS. 2 to 4, the compression chamber 30 is equipped with three injectors 32 located at the apex of an equilateral triangle having a horizontal lower side.

The compression chamber 30 is placed within an air-gas mixing chamber 34 into which issue the injectors 32. The wall of the air-gas mixing chamber 34 turned towards the tubular metal part 22 supports the same number of venturi tubes 36 as there are injectors 32. Each of the venturi tubes 36 is aligned with one of the injectors 32 and issues into the interior of the tubular metal part 22 of the pipe 18, as is illustrated in FIG. 3.

More specifically, the inlet end of each of the venturi tubes 36 is tightly fixed to the aforementioned wall of the air-gas mixing chamber 34 and each of the venturi tubes 36 tightly traverses the wall 37 closing the adjacent end of the tubular metal part 22.

The wall of the air-gas mixing chamber 34 opposite to that supporting the venturi tubes 36 has perforations 38 by which the surrounding air is introduced into the chamber 34. An air filter 40 is placed in said chamber behind the perforations 38 in order to retain any particles present in the air. After traversing the said filter 40, the air introduced into the mixing chamber 34 is mixed with the gas passing out of the injectors 32 in the space separating said injectors from the inlet end of the venturi tubes 36.

In the embodiment illustrated in FIGS. 2 and 3, all the venturi tubes 36 issue at the same level into the tubular metal part 22 at a location relatively close to the wall 37.

A perforated distribution plate 42 is positioned transversely within the tubular metal part 22 slightly beyond the outlet ends of the venturi tubes 36. This distribution plate 42, optionally in association with one or more other perforated distribution plates such as the plate 43 in FIG. 2, internally subdivides the pipe 18 into a certain number of zones A, B and C. The distribution plates 42,43 establish predetermined pressure drops between the zones A, B and C making it possible to ensure a relatively uniform distribution of the air-gas mixture over the entire length of the pipe burner 18.

As is more particularly illustrated by FIG. 4, the tubular metal part 22 has a substantially planar face 44 oriented parallel to its longitudinal axis with an inclination of approximately 60° relative to the vertical. On most of its length, the face 44 has juxtaposed windows 46, which are rectangular or have any other shape. On each of these windows 46 is tightly fixed a rectangular, ceramic material plate 48, whose dimensions are slightly larger than those of the windows 46, so as to completely cover the latter. Each of the ceramic material plates 48 is traversed in the direction of its thickness by a dense network of microperforations 49, through which pass out the air-gas mixture introduced into the pipe burner 18 by the supply means 24.

The fixing of the ceramic material plates 48 to the tubular metal part 22 takes place by tight fixing means. In the embodiment illustrated in FIG. 4, these tight fixing means comprise tongues 50, e.g. formed by stamping in the tubular metal part 22 and lowered onto the plates 48, so as to keep them engaged against the planar surface 44. The tightness of the fixing is ensured by flexible sealing pads 52, which are interposed between the peripheral edge of each of the plates 48 and the frame 54 of the corresponding window 46. These sealing pads 52 more particularly make it possible to preserve the seal between each of the plates 48 and its frame 54, despite the differential expansions which occur between the plate and the tubular metal part 22.

In order to ignite the gas passing out of the pipe burner 18 by means of the microperforations 49 formed in the plates 48, the surface 44 of the tubular metal part 22 also supports, in the vicinity of the end of said part adjoining the supply means 24, means 56 for igniting the gas traversing said microperforations. In known manner, said igniting means 56 comprise an igniting system by groups of sparks, as well as an ionization flame checking system.

It should be noted that the substantially uniform distribution of the air-gas mixture over the entire length of the pipe 18 ensured by the distribution plates 42,43 allows an ignition of the gas at a single end of the pipe. This makes it possible to place all the ducts and electrical conductors at this same end of the pipe 18, which facilitates its assembly and disassembly.

The density of the microperforations 49 formed in the plates 48, as well as their very small cross-section make it possible, after igniting the gas by the igniting means 56, to form microflames within the microperforations 49 formed in the plates. Thus, a heating is obtained in the infrared range.

This feature makes it possible to orient the microflames towards the inner surface of the rotary cylinder 10, in the vicinity of the linen discharge zone, as illustrated in FIG. 1. More specifically, the inclination substantially by 60° relative to the vertical of the microperforations 49, combined with the installation of the pipe 18 in the lower region of the rotary cylinder and with the orientation of the face 44 towards that part of the cylinder which moves downwards during its rotation (FIG. 1), makes it possible to establish a circulation of the combustion products along the inner surface of the cylinder 10 in the opposite direction to its rotation and as illustrated by the arrows F2 in FIG. 1. These combustion products are taken up by the combustion product recovery pipe 20 after they have internally swept most of the cylinder around which circulates the linen to be ironed. This ensures an optimum thermal efficiency of the machine.

It should also be noted that the pipe burner 18 according to the invention can be constructed at a lower cost. This is also a significant advantage compared with the prior art machines.

In a second embodiment of the invention illustrated in FIG. 5, the pipe burner 18 has slightly different characteristics from those described relative to FIGS. 2 to 4, in order to make it possible to regulate the distribution of the heating along the pipe as a function of the type of linen or laundry which it is wished to dry and iron. In this case, the tubular metal part 22 is split in its lengthwise direction into n separate zones (e.g. 3) by perforated distribution plates 42,43, as in the first embodiment. Thus, for example, within the tubular metal part 22 there is an inlet zone A, a central zone B and a terminal zone C. However, instead of all issuing into the inlet zone A, each of the venturi tubes issues into a different zone. Thus, 36*a* designates the venturi tube issuing into the inlet zone A, 36*b* the venturi tube issuing into the central zone B and 36*c* the venturi tube issuing into the terminal zone C.

The inlet end of each of the venturi tubes 36*a*,36*b* and 36*c* then faces an injector 32*a*,32*b*,32*c* communicating with a separate compression chamber 30*a*,30*b*,30*c* respectively. These three compression chambers are placed in a single air-gas mixing chamber 34.

In this case, the supply of gas to each of the compression chambers 30*a*,30*b* and 30*c* is ensured by a separate duct equipped with a dosing tap. Only the duct 26*b* supplying gas to the compression chamber 30*b* and the tap 28*b* placed in said duct are shown in FIG. 5. It is therefore possible to at random supply gas at a controlled flow rate to each of the zones A,B and C in order to take account of the dimensions of the linen to be ironed.

According to an improvement to the embodiment illustrated in FIG. 5, the perforated distribution plates 42 and 43 are installed in the tubular metal part 22, so as to be able to move parallel to the longitudinal axis thereof. The means provided for this purpose can be constituted by any mechanism making it possible to perform a definitive setting when the machine is delivered, or a setting accessible to the user either from the outside of the machine, or by dismantling the pipe burner.

Obviously, the invention is not limited to the embodiments described in exemplified manner hereinbefore and covers all variants thereof. In particular, the dense network of microperforations ensuring the combustion of the gas in the infrared according to the invention can be obtained either by using plates of different types from the ceramic material plates used in the two embodiments described, or by forming the microperforations directly in the material forming the tubular part constituting the pipe. Moreover, in the case where the injection of the air-gas mixture takes place entirely in the inlet zone of the ramp, a single injector-venturi tube assembly can be used.

Throughout the present text, the term plate is understood to mean any solid object provided with perforations or any other object obtained by weaving or compressing or any other fibre or particle assembly means having a perosity permitting the optimum passage of the air-gas mixture.

I claim:

1. Drying and ironing machine having a rotary cylinder and a pipe burner comprising, within the cylinder, a pipe burner, means for supplying the pipe burner with an air-gas mixture, connected to one end thereof, calibrated holes formed in the pipe burner in order to permit the passage of the air-gas mixture, and means for igniting the gas passing out of the calibrated holes, characterized in that the calibrated holes define a network of microperforations having a density and cross-section such that the combustion of the air-gas mixture occurs mainly in the microperforations and the heating which results is mainly in the infrared range.

2. Drying and ironing machine according to claim 1, wherein the microperforations are formed in ceramic material plates.

3. Drying and ironing machine according to claim 2, wherein the pipe comprises a tubular metal part having a substantially planar face parallel to its axis and in which are formed juxtaposed windows, the ceramic material plates being installed in these windows by tight fixing means.

4. Drying and ironing machine according to claim 3, wherein the tight fixing means comprise tongues formed in the tubular metal part and lowered onto the ceramic material plates, as well as flexible sealing pads interposed between said plates and the frames of said windows.

5. Drying and ironing machine according to claim 1, wherein the pipe burner is placed in a lower region of the rotary cylinder and oriented such that the axes of the calibrated holes are directed towards a part of the cylinder close to a linen discharge zone and the gas passing out of the calibrated holes is directed in the opposite direction to the cylinder rotation direction.

6. Drying and ironing machine according to claim 5 also comprising a combustion product recovery pipe placed in an upper region of the rotary cylinder, in the vicinity of a linen introduction zone, so as to ensure that the combustion products sweep a useful part of the cylinder located between the introduction and discharge zones for the linen.

7. Drying and ironing machine according to claim 1, wherein the pipe burner is equipped with at least one perforated distribution plate internally subdividing the pipe in the lengthwise direction thereof into at least two zones.

8. Drying and ironing machine according to claim 7, wherein the supply means issue entirely into a first of said zones adjacent to said end of the pipe, the distribution plate ensuring a substantially uniform distribution of the air-gas mixture along the pipe.

9. Drying and ironing machine according to claim 7, wherein the supply means issue into each of the zones and have distribution means ensuring a controlled supply of each zone with the air-gas mixture.

10. Drying and ironing machine according to claim 9, further comprising a means for moving each distribution plate parallel to the longitudinal axis of the pipe burner.

* * * * *